US005573133A

United States Patent [19]

Park

[11] Patent Number: 5,573,133

[45] Date of Patent: Nov. 12, 1996

[54] CAN STRUCTURE FOR DETACHABLE COUPLING OF CANS

[76] Inventor: Jong S. Park, 7-406 Nungkum Apartment 195-1, Bonri-dong, Dalseo-ku Taegu, Rep. of Korea

[21] Appl. No.: 277,318

[22] Filed: Jul. 25, 1994

[51] Int. Cl.[6] ..... B65D 21/032

[52] U.S. Cl. ..... 220/4.27; 206/509; 220/906

[58] Field of Search ..... 220/4.27, 906, 220/630, 300; 206/509, 511, 503

[56] References Cited

U.S. PATENT DOCUMENTS

| | | | |
|---|---|---|---|
| 1,341,592 | 5/1920 | Ruehle | 220/300 |
| 2,997,199 | 8/1961 | Reachi | 220/630 |
| 3,029,973 | 4/1962 | Burchett | 220/300 |
| 3,369,691 | 2/1968 | Wei | 220/4.27 |
| 4,689,147 | 8/1987 | Leoncavallo et al. | 220/300 |
| 5,339,975 | 8/1994 | Stoner | 220/4.27 |

*Primary Examiner*—Stephen J. Castellano
*Attorney, Agent, or Firm*—Oblon, Spivak, McClelland, Maier & Neustadt, P.C.

[57] ABSTRACT

A can structure for detachable coupling of at least two cans. The detachable coupling structure includes a plurality of grooves recessed on an outside surface of a bottom peripheral ring of each can such that each of them has a receiving portion and a locking portion. A plurality of projections extend inwardly from an inside surface of a top peripheral flange of each can at positions corresponding to the grooves. In accordance with the above structure, the two cans are detachably coupled to each other by inserting the projections of one can in the receiving portion of the corresponding grooves of the other can and turning the two cans in opposed directions. In a second embodiment of this invention, the projections are formed by partial inward bending of an edge of the top peripheral flange of each can at positions corresponding to the grooves. The detachable coupling of the cans can be repeated several times so as to form a line of cans without causing any problem. Neither a removable tap nor a tap handle of the lid of the can causes a hinderance when coupling the cans to each other. Accordingly, the cans, irrespective of presence of their taps and tap handles, cause no problem in their coupling.

8 Claims, 6 Drawing Sheets

CAN STRUCTURE FOR DETACHABLE COUPLING OF CANS

BACKGROUND OF THE INVENTION

1. Field of the Invention

The present invention relates in general to cans such as beverage cans and, more particularly, to a structure in such cans for simply achieving detachable coupling of two or more cans.

2. Description of the Prior Art

Most of typical cans have been produced and commercialized in handheld sizes but have no means for their detachable coupling to each other. Therefore, most of the typical cans having no detachable coupling means are simply kept or carried with a person when one or two cans need keeping or carrying with the person. This creates a problem that it is very difficult to keep or carry them when three or more cans need simultaneously keeping or carrying with the person.

As is well known to those skilled in the art, the cans are conventionally formed of iron thin plates or aluminum thin plates which should be saved from the viewpoint of saving of resources. In order to save the resources, the emptied cans made of iron or aluminum thin plates need recovering and reproducing. However, since most of the typical cans have no means for coupling them to each other, the emptied cans are inevitably discarded separately, thus causing a problem in that they must be collected one by one when recovering them for their recycling. Particularly when the typical cans having no detachable coupling means are discarded separately in the open air, they will be scattered in the forest or in the sands in the open air. Hence, when the emptied cans separately discarded in the open air are collected for their recycling, they must be picked up while being found out one by one, and this creates problems for can collectors. Hence, the cans separately discarded in the open air may be neglected. This not only runs counter to the recent trend of resource saving but also causes environmental pollution.

In the prior art, there have been proposed detachable can coupling structures and detachable can coupling methods for overcoming the above problems caused by the typical cans having no coupling means. However, the prior art structures and methods for coupling the cans are not practically used because of their structural problems as will be described later herein.

Japanese Utility Model Laid-open Publication No. Sho. 54-58350 discloses a can having, at its top and bottom, a screw type coupling structures for vertically detachably coupling the cans to each other. However, this can causes a hygienic problem in that the contaminants on its top coupling structure may be introduced into the human body when drinking the beverage from the can. That is, the screw type top coupling structure has recesses between its threads, and contaminants may be present in those recesses. In this regard, the contaminants remaining on the top coupling structure may be directly introduced into the human body along with the beverage when drinking the canned beverage, thus causing a hygienic problem. In addition, each of the top and bottom coupling structures of the above can is shaped in the form of a predetermined width of annular strip extending from the top periphery or the bottom periphery of the can. The top and bottom screw type coupling structures of the can are thus weak in their bending strengths so that they are apt to be deformed or bent even when they are subjected to a weak outside shock. When either of the top and bottom coupling structures of the can is deformed by an outside shock, this can cannot be coupled to another can at its top or bottom. In this regard, the above can is attended with a problem in its practical use.

Japanese Utility Model Laid-open Publication No. Sho. 63-1727 discloses a pair of cans having another type of can coupling structure for detachably coupling the two cans to each other. In this device, the can coupling structure comprises a slot flange extending upwardly from the top periphery of the bottom can to a predetermined length and slitted at predetermined positions so as to form diametrically opposed locking slide slots in an L-shape. In order to engage with the above L-shaped locking slide slots of the bottom can for achieving the detachable coupling of the cans, the top can is provided with a pair of locking slide projections extending outwardly from its bottom side at positions corresponding to the above locking slide slots. In accordance with this device, the two cans or the top and bottom cans are coupled to each other by bringing the projections of the top can into engagement with the L-shaped slots of the bottom can. However, when the top periphery of the bottom can is partially slitted so as to form the L-shaped locking slide slots, the can may achieve no desired hermetical sealing due to the structural limit of the typical can. Moreover, even when the L-shaped locking slots are formed on the top periphery of the can while providing the can with the desired hermetical sealing, another problem is caused by the material of the can. That is, since the can is made of the iron thin plate or the aluminum thin plate as described above, the slot flange of the bottom can having the L-shaped slots is apt to be deformed or bent by an outside shock, thus failing in its engagement with the projections of the top can. Particularly when the can is made of the aluminum thin plate, which plate is softer and shows less elasticity than the iron thin plate, the above problem of bending deformation of the slot flange will become worse. Accordingly, this coupling structure can not be adapted to typical cans.

People, young and old, men and women in many parts of the world enjoy themselves over the canned beverage irrespective of the above problems caused by the prior art cans so that a new can needs proposing. Such a new can should have a new structure for overcoming the above problems of the prior art cans and should provide for detachably coupling the cans to each other when keeping and carrying them with the person. The recent trend of saving of resources promotes such a proposal of the new cans having the new detachable coupling structure suitable for making the emptied cans easily simply recovered for their recycling.

OBJECTS OF THE INVENTION

It is, therefore, an object of the present invention to provide a can with a structure for detachable coupling of cans which easily achieves the desired manual detachable coupling of the cans to each other without addition of another means, thus facilitating the keeping or carrying of two or more cans in the user's hands, the coupling structure also allowing repeated detachable coupling of the cans with causing no problem.

It is another object of the present invention to provide a can with a structure for detachable coupling of cans, which structure easily manually detachably couples the cans to each other when discarding and keeping the cans after emptying the cans of their contents, thus allowing the emptied cans to be discarded or kept while being coupled to each other, and thus allowing the emptied cans to be more efficiently recovered for their recycling and remarkably improving the recovery rate of the emptied cans.

It is still another object of the present invention to provide a can structure for detachable coupling of cans which is easily adapted to a typical can with change of neither shape nor structure of the typical can, which is easily put to practical use and which may be efficiently used as a result of production with the typical cans in mass production.

It is still another object of the present invention to provide a can with a structure for detachable coupling of cans which is produced in mass production by a simple process and with low cost due to its simple construction.

It is still another object of the present invention to provide a can with a structure for detachable coupling of cans which saves cost since its coupling structure, while achieving the above objects, nevertheless causes no or very little increase of the amount of material used in the can.

It is still another object of the present invention to provide a can with a structure for detachable coupling of cans, which, in case that the can is a beverage can, coupling structure is favorable to a matter of hygienic problem when a person drinks the canned beverage while directly touching the predetermined position of the flange of the can with his or her lips.

It is still another object of the present invention to provide a can with a structure for detachable coupling of cans, which coupling structure gives no bad influence upon the structural strength of the can because the coupling structure does not comprise a portion slitted into the can body, a portion welded on the can body, or a portion riveted into the can body.

SUMMARY OF THE INVENTION

In order to accomplish some or all of the above objects, the present invention provides, in accordance with a first embodiment of the invention, a can having a detachable coupling structure, the structure comprising a top flange having a pair of diametrically opposed projections extending from the inside surface of the flange, and a bottom ring having a pair of diametrically opposed grooves recessed on the outer surface of the bottom ring at positions corresponding to the above projections, each of the grooves having a receiving portion for entry the projection and a locking portion for locking it. When coupling two cans of the first embodiment to each other, the two cans are vertically aligned with each other such that the bottom of one can faces the top of the other can simultaneously with aligning the projections of the second can with the grooves of the first can. After inserting the projections of the second can into the corresponding grooves of the first can, the two cans are manually turned in opposed directions so as to be coupled to each other. As a result of repeating the above process, a plurality of cans are coupled to each other so as to form a line of cans. The manual separation of the coupled cans is achieved by simply reversing the above can coupling process. The detachable coupling of the cans of the first embodiment can be repeated without causing any problem. In addition, with this embodiment neither a removable tap nor the tap handle of the lid of either can causes a hindrance when coupling the cans to each other. Accordingly, the cans, irrespective of the presence of removable taps and tap handles, cause no problem in their coupling.

In accordance with a second embodiment of this invention, the projections are formed by partially inwardly bending the edge of the top flange. In this second embodiment, the bottom ring of the can has a pair of diametrically opposed grooves recessed on the outer surface of the bottom ring at positions corresponding to the above bending projections, each of the grooves having a receiving portion for entry the projection and a locking portion for locking it. When coupling two cans of the second embodiment to each other, the two cans are vertically aligned with each other such that the bottom of one can faces the top of the other can simultaneously with aligning the projections of the second can with the grooves of the first can. After inserting the projections of the second can into the corresponding grooves of the first can, the two cans are manually turned in opposed directions so as to be coupled to each other. When repeating the above process, a plurality of cans are coupled to each other so as to form a line of cans. The manual separation of the coupled cans is achieved by simply reversing the above can coupling process. The detachable coupling of the cans of the second embodiment can be repeated without causing any problem. In addition, neither a removable tap nor a tap handle of the lid of the can causes a hindrance when coupling the cans to each other. Accordingly, the cans, irrespective of the presence of taps and tap handles, cause no problem in their coupling.

BRIEF DESCRIPTION OF THE DRAWINGS

The above and other objects, features, and other advantages of the present invention will be more clearly understood from the following detailed description taken in conjunction with the accompanying drawings.

DESCRIPTION OF THE PREFERRED EMBODIMENTS

The First Embodiment

Figure 1:
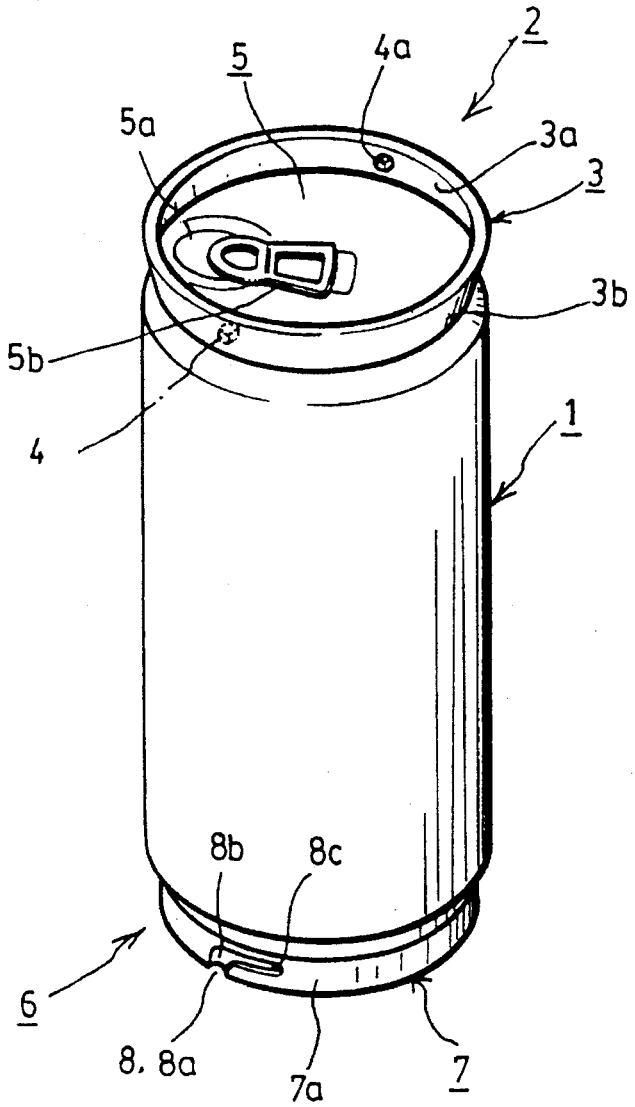
FIG. 1 is a perspective view of a can with a structure for detachable coupling of cans in accordance with a first embodiment of the present invention.
Figure 2:
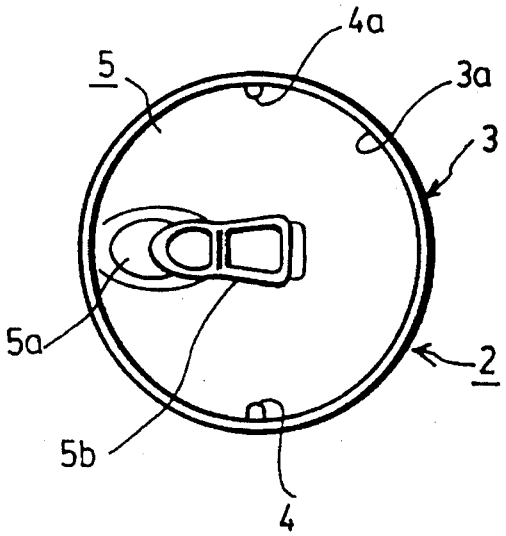
FIG. 2 is a plan view of the can of FIG. 1.
Figure 3:
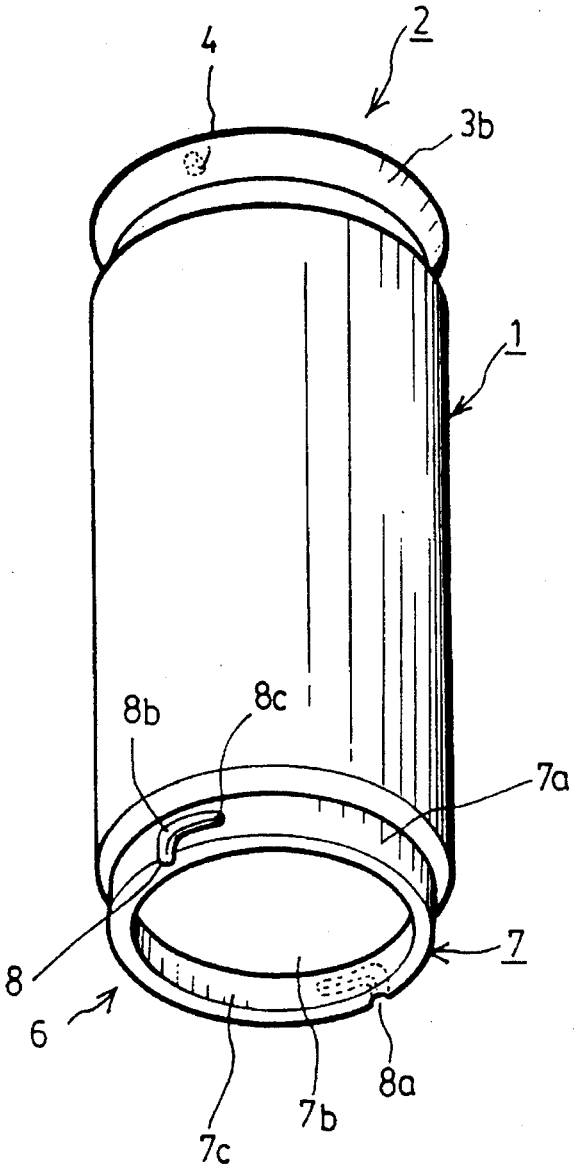
FIG. 3 is a bottom perspective view of the can of FIG. 1
Figure 4:
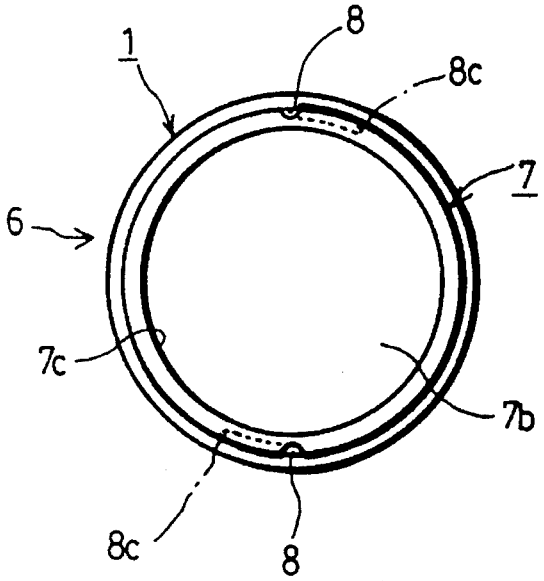
FIG. 4 is a bottom view of the can of FIG. 1.

With reference to the drawings, FIGS. 1 to 4 show a can with a structure for detachable coupling of cans in accordance with a first embodiment of the present invention. In these drawings, the top of a can 1 is designated by the numeral 2. The top 2 of the can 1 is provided with a circular top peripheral flange 3 which integrally extends longitudinally from the periphery of a lid 5 of the can 1 by a predetermined length. The lid 5 is seamed to the top 2 of the can 1. The circular top peripheral flange 3 tapers slightly radially outwardly so as to let the user drink the canned beverage more easily.

In order to provide a detachable coupling structure for the can 1, the inside surface 3*a* of the circular top peripheral flange 3 includes two or more (preferably, and as illustrated, two) projections 4 and 4*a*. If there are two projections 4 and 4*a*, they are preferably diametrically opposed. The projections 4 and 4*a* may be formed in a variety of shapes, such as hemispherical, conical, and hexahedral. The projections 4 and 4*a* extend radially inwardly from the inside surface 3*a* of the circular top peripheral flange 3. It is preferred to form the projections 4 and 4*a* on the inside surface 3*a* of the circular top peripheral flange 3 at positions spaced apart from the portion contacted by the lips.

The bottom 6 of the can 1 is provided with a circular bottom ring 7 extending longitudinally downwardly from the bottom periphery of the can 1 by a predetermined length. The circular bottom ring 7 is provided with two or more coupling grooves 8 and 8*a* on its outside surface. The positions, shapes, and numbers of the grooves 8 and 8*a* provided on the circular bottom ring 7 depend upon those of the corresponding projections 4 and 4*a*. Each of the grooves 8 and 8*a* is recessed on the outside surface 7*a* of the circular bottom ring 7 to a predetermined depth so as to form an L-shaped recess having a bent portion 8*b* and ends 8*c*. The L-shaped recess has, vertically, a receiving portion for entry the projection, and, horizontally, a locking portion for locking the projection. Each of the grooves 8 and 8*a* is preferably formed in such a manner that the depth and/or the width of its horizontal section is gradually reduced in the direction from the bent portion 8*b* to the end 8*c*. Due to the gradual reduction of the depth and or the width of the horizontal section of each groove, the projections 4 and 4*a* are tightly seated on the ends 8*c* of the corresponding grooves 8 and 8*a*.

In a conventional manner, the top 2 of the can 1 is hermetically sealed by the lid 5. The lid 5 is provided with a removable tap 5*a* which is defined by a cut line and which will be drawn apart from the lid 5 prior to drinking of the canned beverage. In order to facilitate removing the removable tap 5*a* from the lid 5, a tap handle 5*b* is riveted to the removable tap 5*a*.

Figure 5:
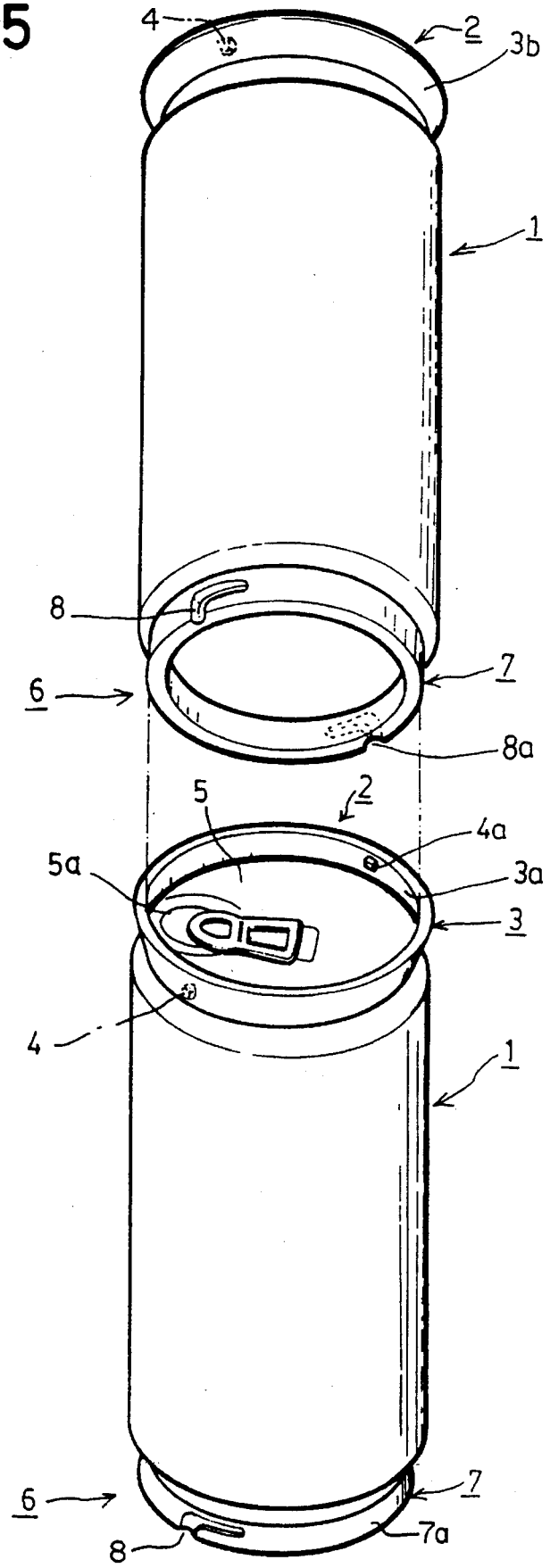
FIG. 5 is a perspective view of two cans of FIG. 1, showing coupling and separation of the cans to and from each other.

Turning to FIG. 5, there is shown in a perspective view two cans 1. This drawing shows the coupling and separation of the cans 1 of this invention to and from each other without addition of another means.

As shown in this drawing, when coupling at least two cans 1 to each other such as for carrying them with a person or discarding them after emptying their contents, the two cans 1 are vertically aligned with each other in such a manner that the bottom 6 of one can 1 meets with the top 2 of the other can 1. At this time, the coupling grooves 8 and 8*a* of one can 1 meet with the top projections 4 and 4*a* of the other can 1. The projections 4 and 4*a* of the second can 1 are, thereafter, inserted into the corresponding grooves 8 and 8*a* of the first can 1 until they are stopped by the bent portions 8*b* of the L-shaped grooves 8 and 8*a*. At that time, the circular bottom ring 7 of the first can 1 is inserted into the circular top peripheral flange 3 of the second can 1 so that the outside surface 7*a* of the circular bottom ring 7 of the first can 1 comes into contact with the inside surface 3*a* of the circular top peripheral flange 3 of the second can 1. When the projections 4 and 4*a* of the second can 1 are stopped by the bent portions 8*b* of the grooves 8 and 8*a*, respectively, the two cans 1 are turned in opposed directions so as to slide the projections 4 and 4*a* in the horizontal sections of the grooves 8 and 8*a* until the projections 4 and 4*a* are seated on the ends 8*c* of the grooves 8 and 8*a*. Of course, it should be understood that the desired coupling of the cans may be achieved by turning of one of the cans 1 with respect to the other can 1 gripped by a hand. When the two cans 1 are completely coupled to each other in the above manner, the top 2 of the second can 1 and the bottom 6 of the first can 1 substantially meet with each other as best seen in the enlarged sectional view of FIG. 6.

Detachable coupling of a plurality of cans 1 into a line of cans is achieved by repeating the above-mentioned can coupling process. In the present invention, the number of cans 1 which can be coupled to each other without causing any problem depends upon the strength, the thickness, and the structure of the material of the can 1.

On the other hand, the repeated detachable coupling which does not cause a problem indicates a case that can 1 is coupled, separated and then detachably recoupled, causing no problem.

Here, if the material of the can is poor in elasticity or easily abraded, even when the detachable recoupling after the coupling and then separation of can 1 is performed merely once or several times, part of projections 4 and 4*a* or the locking portions of grooves 8 and 8*a* is distorted (not returned to the original place due to lack of elasticity), or abraded due to their friction. For this reason, when projections 4 and 4*a* are seated to a predetermined position (where the projections and locking portions are locked tight) of the locking portions of grooves 8 and 8*a*, there is created a gap therebetween. This prevents cans 1 from being detachably but tightly coupled, which is the defect of the above-described advantages of the present invention.

In this hand, if the material of can 1 is poor in elasticity or easily abraded, the locking portions of grooves 8 and 8*a* are formed to extend, from the predetermined position where projections 4 and 4*a* are locked tight, by a predetermined length considered to solve that problem. The thus formed locking portions of grooves 8 and 8*a* are gradually reduced in depth and or width, until the end of the extended portion.

As a result, when projections 4 and 4*a* arrive at the predetermined position for fixing them to the locking portions of grooves 8 and 8*a*, they are fixed tight at the extended locking portion, in spite of the gap. This enables tight but detachable coupling of cans 1. Such effect is made continuously within the range previously considered. By doing so, repeated detachable coupling is enabled without problem.

Figure 6:
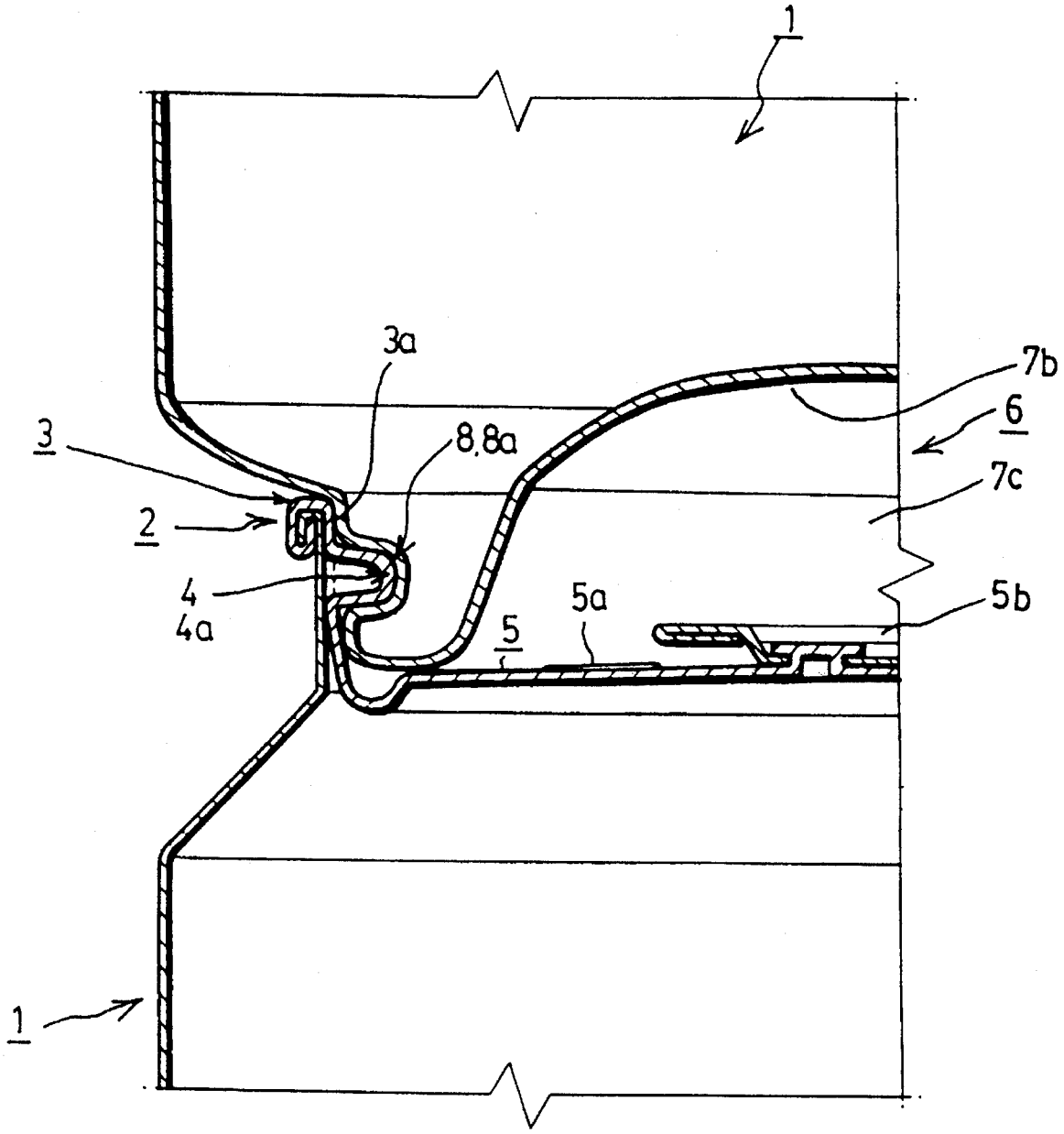
FIG. 6 is a partially enlarged sectional view of the two cans of FIG. 5, showing the coupling state of the cans.

In the present invention, neither the removable tap 5*a* nor the tap handle 5*b* of the lid 5 of the can 1 causes a hindrance when coupling the cans 1 to each other as best seen in FIG. 6. That is, the bottom 6 of each can 1 is provided with a space defined by the circular bottom ring 7 and a domed bottom plate 7*b*. Due to this, there is no hindrance caused by either the removable tap 5*a* or the tap handle 5*b* when coupling the cans 1 to each other. Hence, both the cans 1 having both the removable taps 5*a* and the tap handles 5*b* (otherwise stated, the cans 1 charged with their contents and hermetically sealed) and the cans 1 having neither the removable taps 5*a* nor the tap handles 5*b* (otherwise stated, emptied cans 1 to be discarded) cause no problem in their coupling.

When separating the coupled cans 1 from each other, the above coupling process is reversely repeated. That is, the two coupled cans 1 are turned in opposed directions so as to lead the projections 4 and 4*a* from the ends 8*c* of the grooves 8 and 8*a* to the bent portions 8*b* of the grooves 8 and 8*a*, respectively. When the projections 4 and 4*a* reach their respective bent portions 8*b* of the grooves 8 and 8*a*, the two cans 1 are forced so as to be away from each other. The projections 4 and 4*a* are, therefore, free from their respective grooves 8 and 8*a* at the same time and separate the cans 1 from each other.

The Second Embodiment

Figure 7:
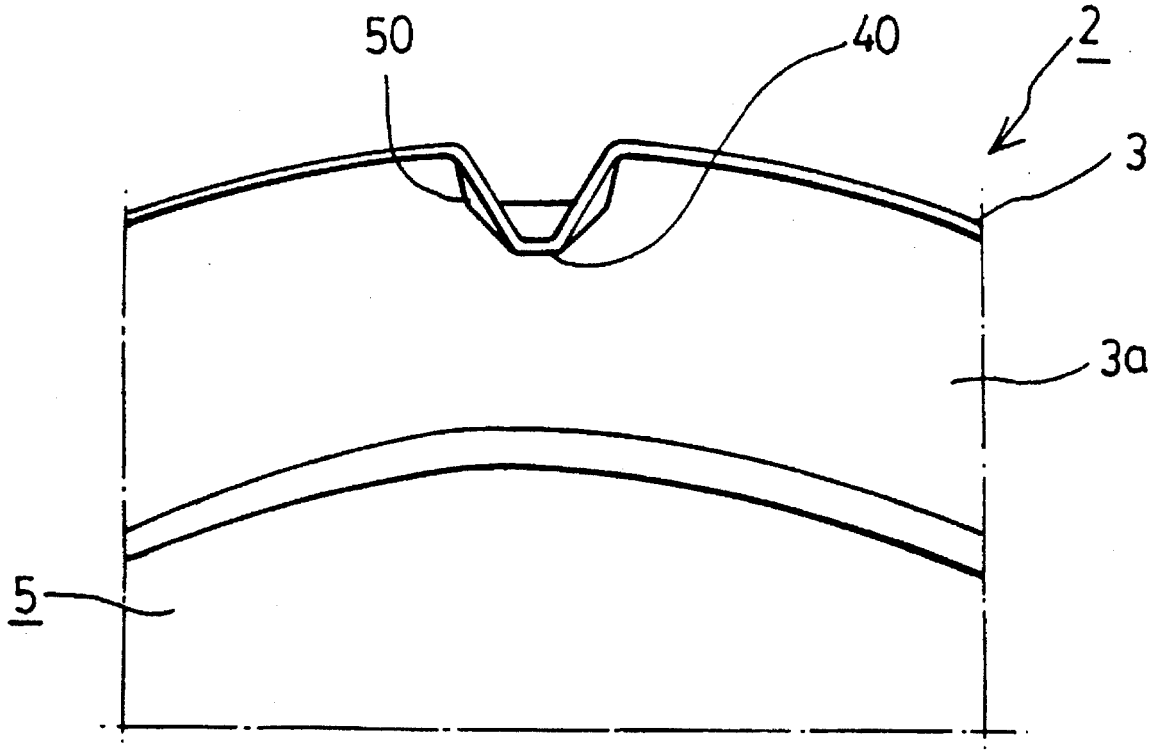
FIG. 7 is a partially enlarged view of a projection provided at a top flange of a can in accordance with a second embodiment of the present invention.

Turning to FIG. 7, there is shown in a partially enlarged view a projection provided at the circular top peripheral flange 3 of a can 1 in accordance with a second embodiment of the present invention. In the second embodiment, the projections 40, there being only one shown, are formed by partially inwardly bending the edge of the circular top peripheral flange 3.

Of course, it should be understood that varieties of projections 40 may be formed by simply changing the bending angle and the shape of the projection 40 and the shapes of opposed sides 50 of the projection 40. For example, each projection 40 may be bent at an acute angle, a right angle, or an obtuse angle. The opposed sides 50 of each projection 40 may be bent inwardly so as to let the projections 40 show a nearly enclosed profile when sectioned. In the same manner, the sectional profile of the projections 40 may show a V-shaped or a U-shaped profile.

In order to engage with the projections 40, each can 1 will of course be provided with grooves (not shown) at its circular bottom ring 7 as described for the first embodiment.

The second embodiment yields the same result as that described for the first embodiment without affecting the functioning of this invention, and further explanation is thus not deemed necessary. More specifically, the second embodiment yields more favorable effects than the first embodiment. This will be understood clearly when the first and final cases of the later-explained further modifications are described.

Further Modifications

In the first embodiment shown in FIGS. 1 to 6, the circular top peripheral flange 3 of the lid 5 is previously provided with the projections 4 and 4*a* before the lid 5 is hermetically seamed to the top of the can 1. This structure is best seen in FIG. 6.

Figure 8:
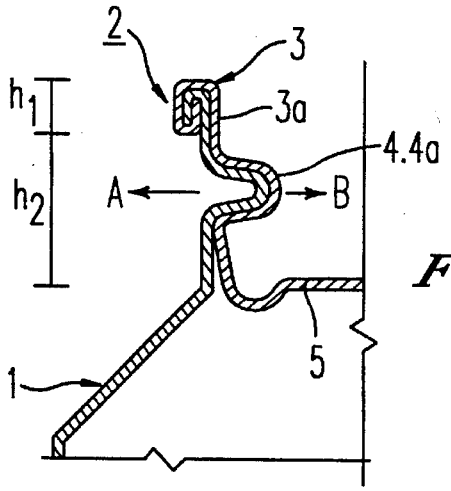
FIG. 8 is a partially enlarged sectional view showing a first modification.

However, as shown in FIG. 8, the projections 4 and 4*a* may not be formed on the lid 5 until the lid 5 is hermetically seamed to the top of the can 1. In this case, the projections 4 and 4*a* may be formed on the circular top peripheral flange 3 of the lid 5 after seaming the lid 5 to the top of the can 1. In order to provide the projections 4 and 4*a* for the can 1 after seaming of the lid 5, the projections 4 and 4*a* for the can 1 after seaming of the lid 5, the projections 4 and 4*a* may be formed, as shown in FIG. 8, on the portion $h_2$ lower than the portion $h_1$ of the inside surface 3*a* of the circular top peripheral flange 3 of the can 1. It is thus required to heighten the portion $h_2$, and this causes a small increase of the amount of material used in making the can.

Figure 9:
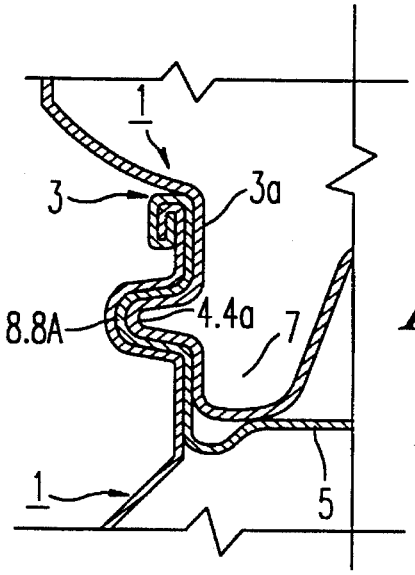
FIG. 9 is a partially enlarged sectional view showing a second modification.

In accordance with another modification of this invention, shown in FIG. 9, the grooves 8 and 8*a* may be formed on the inside surface 3*a* of the circular top peripheral flange 3 while the projections 4 and 4*a* may be formed on the outside surface 7*a* of the circular bottom ring 7 as shown in FIG. 9. However, when forming two or more L-shaped grooves 8 and 8*a*, which are far larger than the projections 4 and 4*a*, on the inside surface 3*a* of the circular top peripheral flange 3, the grooves 8 and 8*a* partially invade the portion where the user will directly touch the can with his or her lips when drinking the canned beverage. The circular top peripheral flange 3 with the grooves 8 and 8*a* is thus apt to be contaminated at the grooves 8 and 8*a*. However, it is difficult to wipe the contaminants out of the grooves 8 and 8*a*. Accordingly, the circular top peripheral flange 3 with the grooves 8 and 8*a* may cause a hygienic problem. Because of this, this modification may be regarded as the worst embodiment.

Figure 10:
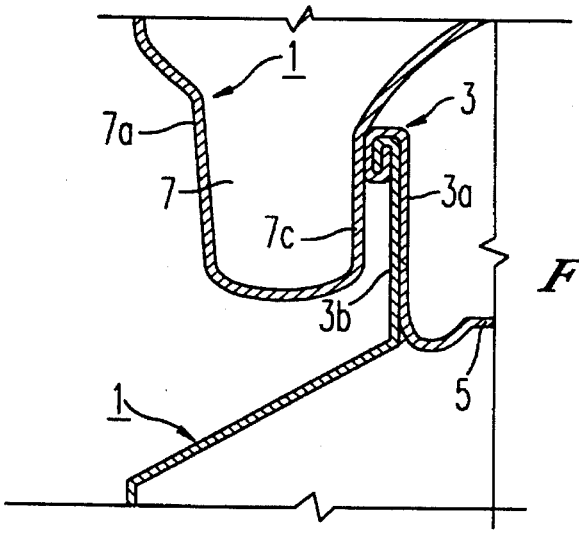
FIG. 10 is a partially enlarged sectional view showing a third modification.

In accordance with still another modification of this invention, shown in FIG. 10, the circular top peripheral flange 3 of the can 1 may be inserted into the circular bottom ring 7 of another can 1 when detachably coupling the cans 1 to each other as shown in FIG. 10. In this case, the projections 4 and 4*a* may be formed on the outside surface 3*b* of the circular top peripheral flange 3 while the grooves 8 and 8*a* may be formed on the inside surface 7*c* of the circular bottom ring 7. Alternatively, the grooves 8 and 8*a* may be formed on the outside surface 3*b* of the circular top peripheral flange 3, while the projections 4 and 4*a* may be formed on the inside surface 7*c* of the circular bottom ring 7. However, when the projections 4 and 4*a* are formed on the outside surface 3*b* of the circular top peripheral flange 3 and the grooves 8 and 8*a* are formed on the inside surface 7*c* of the circular bottom ring 7, the first problem described above will be caused, since the projections 4 and 4*a* will have to be formed on the portion $h_2$ in the direction A in FIG. 8. On the other hand, when the grooves 8 and 8*a* are formed on the outside surface 3*b* of the circular top peripheral flange 3 and the projections 4 and 4*a* are formed on the inside surface 7*c* of the circular bottom ring 7, the second problem described above will be caused.

In the embodiment shown in FIG. 7, the edge of the circular top peripheral flange 3 is partially bent inwardly so as to form the projections 40 after seaming the lid 5 to the top 2 of the can 1. However, in accordance with still another modification, the circular top peripheral flange 3 of the can 1 may be inserted into the circular bottom ring 7 of another can 1 when detachably coupling the cans 1 to each other as described above. In this case, the edge of the circular top peripheral flange 3 is partially bent outwardly so as to form the projections 40, while the inside surface 7*c* of the circular bottom ring 7 is recessed so as to form the grooves 8 and 8*a*. This embodiment does not cause any of the above described problems.

Caveat

Although the preferred embodiments of the present invention have been disclosed for illustrative purposes, those skilled in the art will appreciate that various modifications, additions and substitutions are possible without departing from the scope and spirit of the invention as defined by the accompanying claims.

What is claimed as new and desired to be secured by Letters Patent of the United States is:

1. A can capable of detachably coupling to another can, said can comprising:

(a) a plurality of grooves each of which has a vertical section and a horizontal section recessed into a surface of a bottom peripheral ring such that each of them shows an L-shaped profile having a bent portion and an end and (b) a plurality of projections extending from a surface of a top peripheral flange at positions corresponding to said plurality of grooves, (c) wherein each of said plurality of grooves is formed in such a manner that the depth of its horizontal section is gradually reduced in the direction from its bent portion to its end and the width of its horizontal section is gradually reduced in the direction from its bent portion to its end, whereby two cans may be detachably coupled to each other by inserting the projections of one can in the vertical sections of the corresponding grooves of the other can and turning the two cans in opposed directions.

2. A can as recited in claim 1 wherein:

(a) said plurality of grooves are recessed into the outside surfaces of said peripheral ring and (b) said plurality of projections extend inwardly from said inside surface of said top peripheral flange.

3. A can capable of detachably coupling to another can, said can comprising:

(a) a plurality of grooves each of which has a vertical section and a horizontal section recessed into a surface of a bottom peripheral ring such that each of them shows an L-shaped profile having a bent portion and an end and (b) a plurality of projections formed by partial bending of an edge of a top peripheral flange at positions corresponding to said plurality of grooves, (c) wherein each of said plurality of grooves is formed in such a manner that the depth of its horizontal section is gradually reduced in the direction from its bent portion to its end and the width of its horizontal section is gradually reduced in the direction from its bent portion to its end, whereby two cans may be detachably coupled to each other by inserting the projections of one can in the vertical sections of the corresponding grooves of the other can and turning the two cans in opposed directions.

4. A can as recited in claim 3 wherein:

(a) said plurality of grooves are recessed into the outside surface of said peripheral ring and (b) said plurality of projections extend inwardly from said inside surface of said top peripheral flange.

5. A can as recited in claim 4 wherein said plurality of grooves are formed in such a manner that their locking portions are formed to extend from a predetermined position by a predetermined length previously considered to locking said projections, and the extended portion of said locking portions is formed in such a manner that its vertical section is reduced gradually toward the end, whereby two cans may be detachably coupled to each other by inserting the projections of one can in the receiving portion of the corresponding grooves of the other can and turning the two cans in opposed directions, and when the projections or grooves are distorted (not returned to the original position due to lack of elasticity) or abraded due to their friction, by repeating detachable coupling, and thereby there is created a gap between the projections and locking portions even though the projections arrive at the predetermined position for locking them to the locking portions, the extended portion enables tight locking between the projections and locking portions.

6. A beverage can capable of detachably coupling to another beverage can, said beverage can comprising:

(a) a plurality of grooves each of which has a receiving portion and a locking portion recessed into a surface of a bottom peripheral ring and (b) a plurality of projections formed by partial bending of an edge of a top peripheral flange at positions corresponding to said plurality of grooves, wherein:

(c) said plurality of projections is formed by partial bending of an edge of a top peripheral flange at positions spaced apart from the portion contacted by the lips when a person drinks the canned beverage while directly touching the predetermined position of the flange of the beverage can with his or her lips and (d) said top peripheral flange comprises a top lip or rim of said beverage can, (e) whereby two beverage cans may be detachably coupled to each other by inserting the projections of one beverage can in the receiving portion of the corresponding grooves of the other beverage can and turning the two beverage cans in opposed directions.

7. A can as recited in claim 6 wherein:

(a) said plurality of grooves are recessed into the outside surface of said peripheral ring and (b) said plurality of projections extend inwardly from said inside surface of said top peripheral flange.

8. A beverage can as recited in claim 6 wherein said plurality of grooves are formed in such a manner that their locking portions are formed to extend from a predetermined position by a predetermined length previously considered to locking said projections, and the extended portion of said locking portions is formed in such a manner that its vertical section is reduced gradually toward the end.

* * * * *